US008736183B2

(12) United States Patent
Chao

(10) Patent No.: US 8,736,183 B2
(45) Date of Patent: May 27, 2014

(54) LED DRIVER CAPABLE OF CONTROLLING COLOR/COLOR TEMPERATURE WITH A POWER CARRIER

(76) Inventor: Wen-Shin Chao, Hsien (TW)

( * ) Notice: Subject to any disclaimer, the term of this patent is extended or adjusted under 35 U.S.C. 154(b) by 181 days.

(21) Appl. No.: 13/469,573

(22) Filed: May 11, 2012

(65) Prior Publication Data

US 2013/0264956 A1 Oct. 10, 2013

(30) Foreign Application Priority Data

Apr. 10, 2012 (TW) ..... 101206482 A

(51) Int. Cl.
*H05B 37/00* (2006.01)

(52) U.S. Cl.
USPC ..... 315/186; 315/192; 315/209 R

(58) Field of Classification Search
CPC ..... H05B 33/0863; H05B 33/0815; H05B 33/0551; H05B 33/0857; H05B 33/0845; H05B 33/0824; H05B 33/0833; H05B 37/02; H05B 37/0218
USPC ..... 315/186, 192, 209 R, 291, 294, 297, 315/307, 308, 312
See application file for complete search history.

(56) References Cited

U.S. PATENT DOCUMENTS

| | | | | |
|---|---|---|---|---|
| 7,902,771 | B2 * | 3/2011 | Shteynberg et al. | 315/307 |
| 8,022,634 | B2 * | 9/2011 | Greenfeld | 315/192 |
| 8,264,169 | B2 * | 9/2012 | Shteynberg et al. | 315/307 |
| 8,441,210 | B2 * | 5/2013 | Shteynberg et al. | 315/308 |
| 8,476,844 | B2 * | 7/2013 | Hancock et al. | 315/307 |
| 2011/0187276 | A1 * | 8/2011 | Shteynberg et al. | 315/186 |
| 2012/0153851 | A1 * | 6/2012 | Sauerlaender | 315/192 |
| 2012/0306389 | A1 * | 12/2012 | Shteynberg et al. | 315/186 |
| 2013/0009551 | A1 * | 1/2013 | Knapp | 315/152 |

* cited by examiner

*Primary Examiner* — Vibol Tan
(74) *Attorney, Agent, or Firm* — Jackson IPG PLLC

(57) ABSTRACT

An LED driver capable of controlling color/color temperature with a power carrier connects a power switch with a dimmer for linking an input end of an LED color/color temperature output controller. An LED array disposed on an output end of the controller allows a power cord to transmit a controlling signal. A synchronous and dimmer action detection differentiates an action of the dimmer or pressing times from an ON/OFF count, so that the LED array presents different color temperatures/colors accordingly. An LED condition memory saves the color temperature/color according to an output signal. In adjusting illumination, the dimmer changes an output current for altering the power of the LED array accordingly, which presents a stable light but avoids deviating the color temperature/color and flickering.

7 Claims, 9 Drawing Sheets

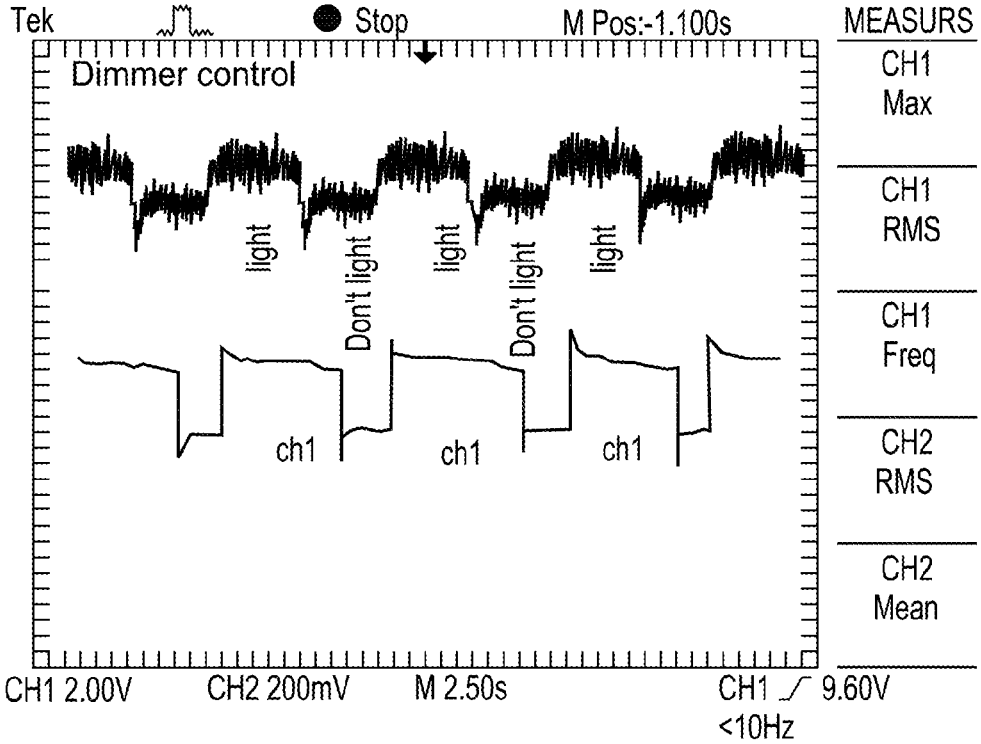
Fig. 5-A

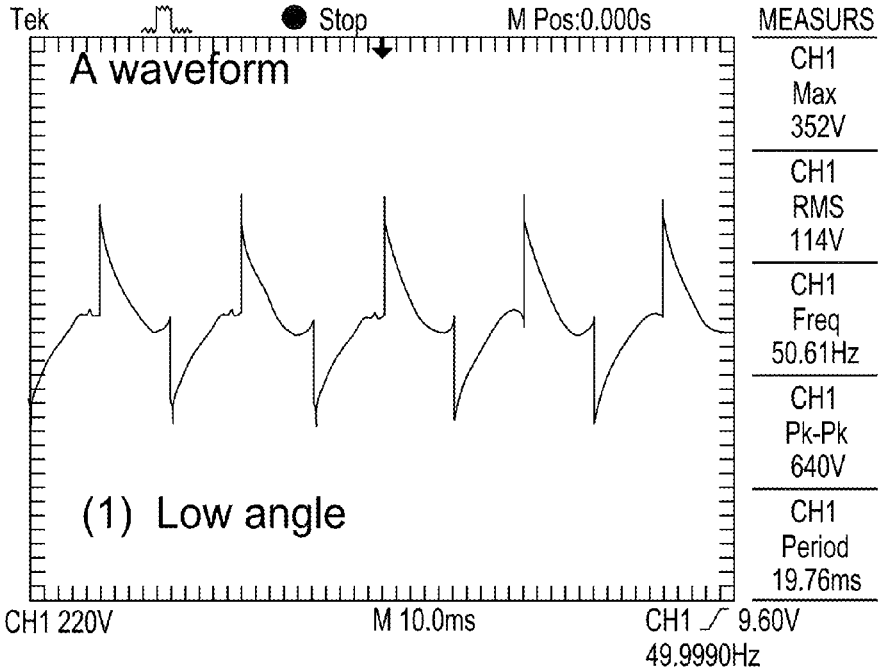
Fig. 5-B
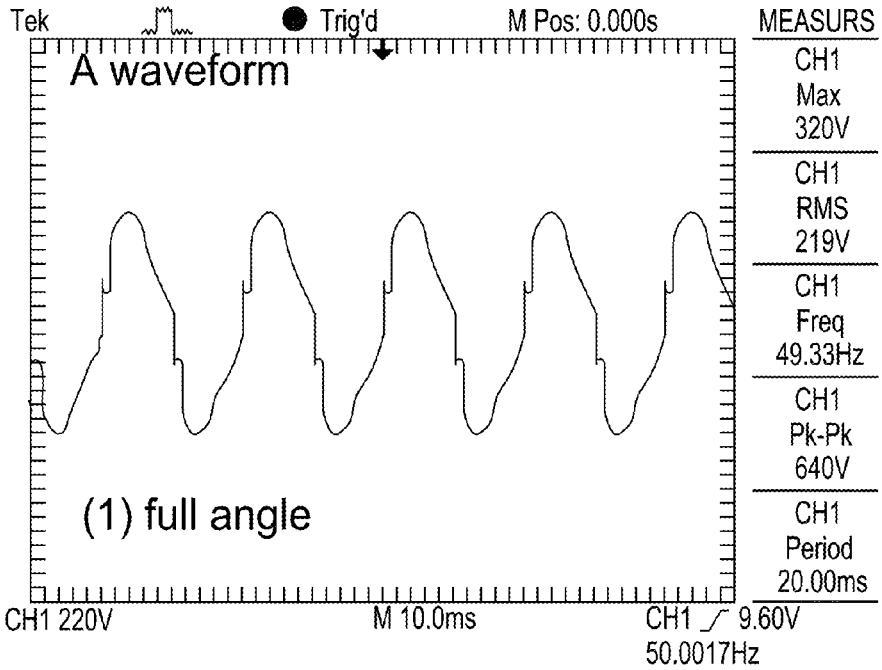
Fig. 5-C

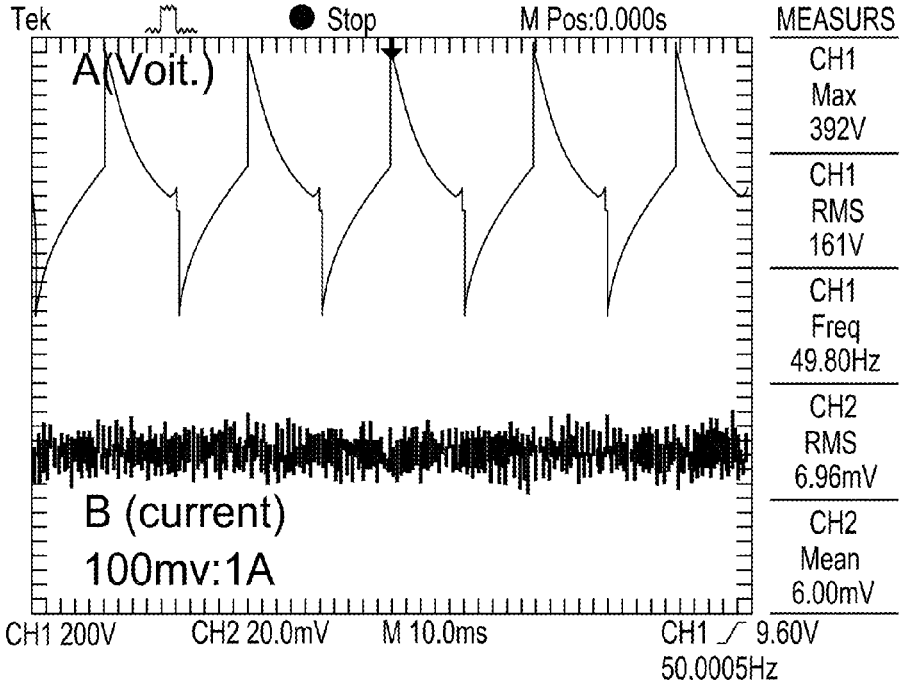
Fig. 5-D
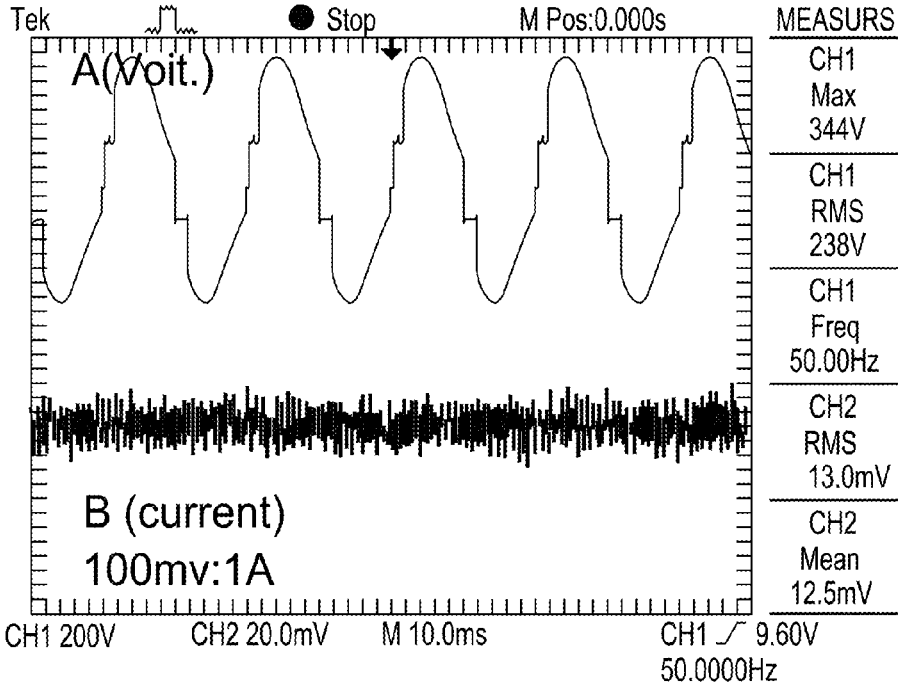
Fig. 5-E

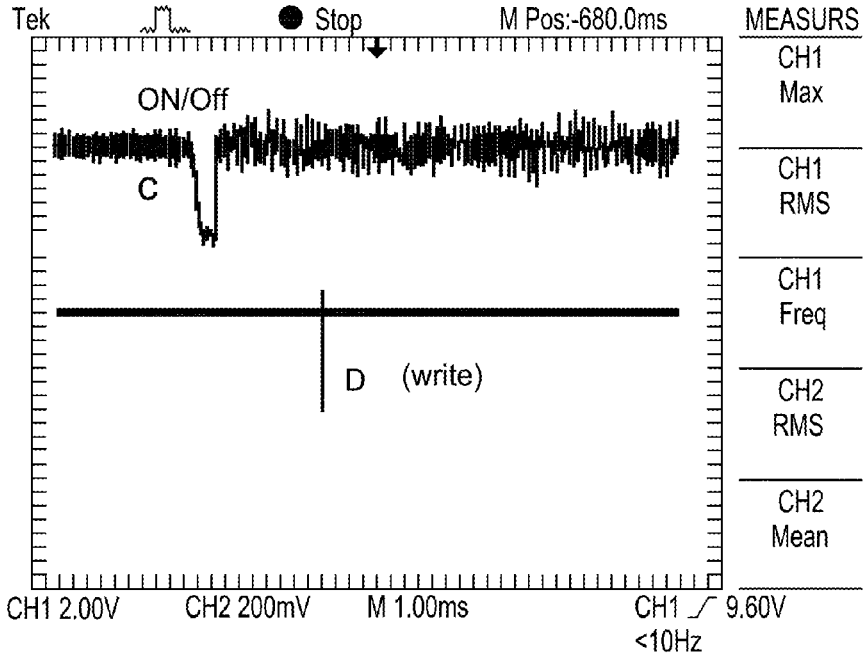
Fig. 6-A
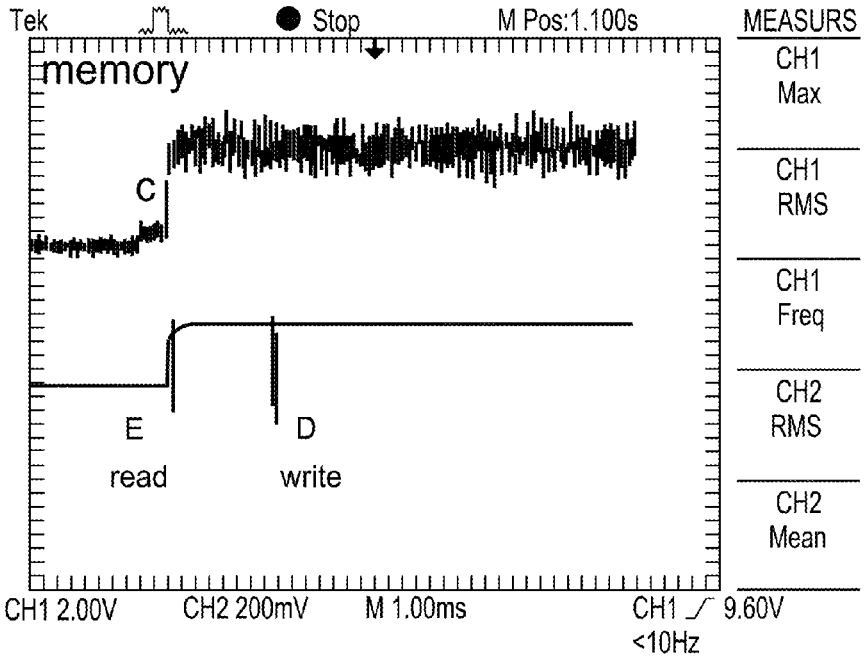
Fig. 6-B

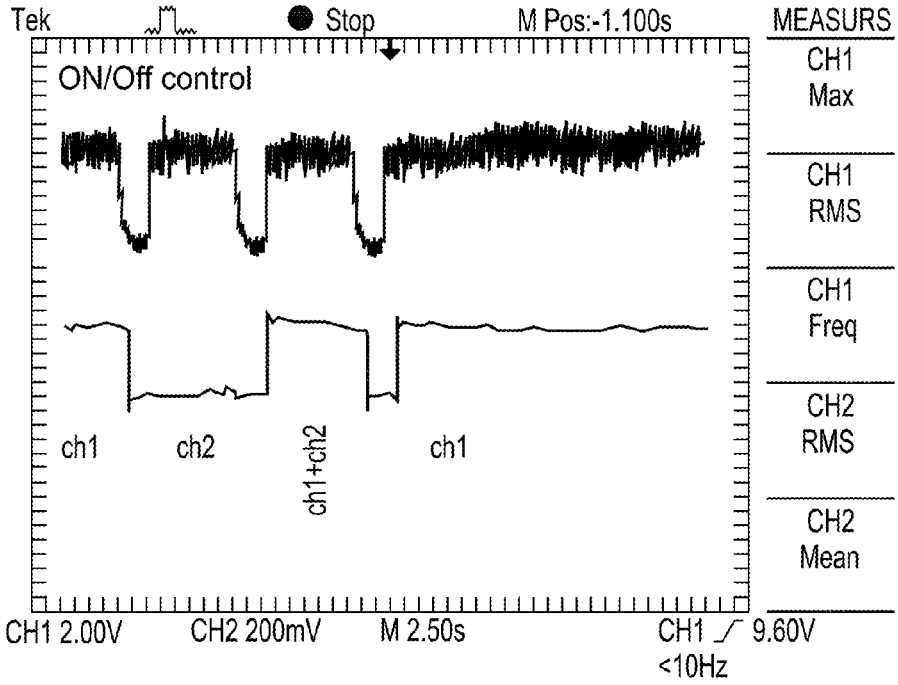
Fig. 6-C
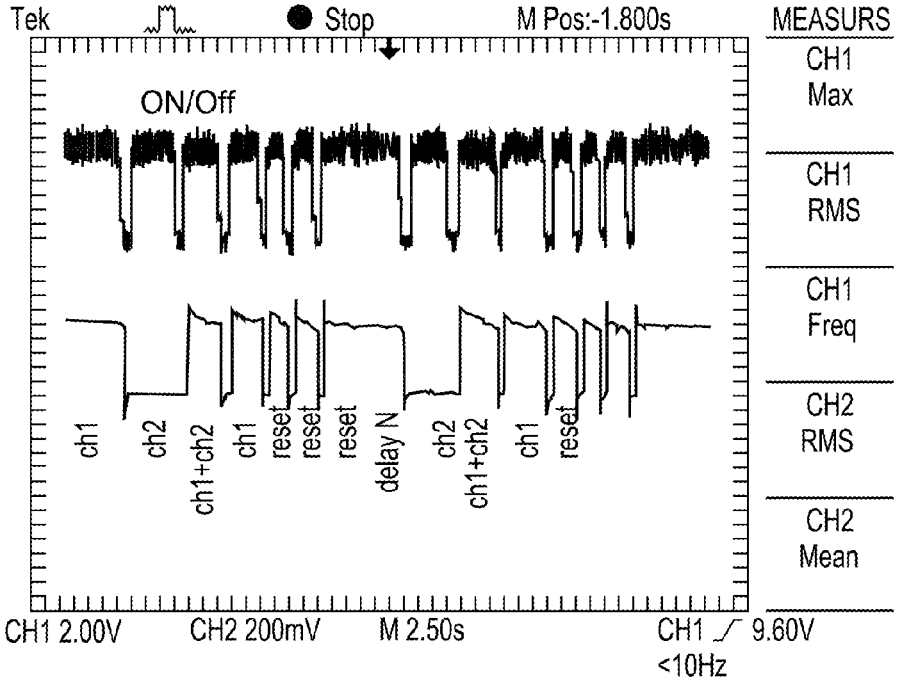
Fig. 6-D

LED DRIVER CAPABLE OF CONTROLLING COLOR/COLOR TEMPERATURE WITH A POWER CARRIER

BACKGROUND OF THE INVENTION

1. Field of the Invention

The present invention relates to an LED driver capable of controlling color/color temperature with a power carrier, in particularly to an LED array that generates stable color temperature or color, which allows a dimmer to constantly maintain the color temperature or color.

2. Description of the Related Art

A color temperature is conventionally stated in the unit of absolute temperature, symbolized by 0° K. Namely, a black material that does not reflect contains −273° C. When the black material is heated to 2000° K, a reddish light is emitted; when the black material is heated to 3000° K, the reddish light becomes orange to yellowish; when the black material is heated to 5000° K, a white light is emitted; when the black material is heated to 8000° K, a bluish light is emitted. Obviously, a higher temperature results in a bluer light; oppositely, a lower temperature results in a redder light. The concept of color temperature is commonly applied to light building interiors for presenting four seasons. For example, in summer, a higher color temperature (over 6000° K) may be adopted for allowing a bluish color to present a fresher atmosphere; in winter, a lower color temperature (below 3300° K) may be adopted for allowing a reddish color to present a warmer atmosphere; as to spring and fall, a middle color temperature (about 3000° K to 6000° K) may be adopted for allowing a blue color to present a cooler atmosphere. There are also some researches indicating that the colored light and proper color temperature benefit growing certain plants or animals, which will be emphasized and developed in the future.

The applicant of the present invention disclosed an R.O.C. patent No. M416294 of a "CONTROLLER FOR ALTERING A COLOR TEMPERATURE OF AN LED". Wherein, a power switch or an extra controlling switch is able to trigger a color temperature adjuster to emit signals, thereby changing a color temperature of the LED. Accordingly, the color temperature, the color, and illumination of the LED are controlled.

SUMMARY OF THE INVENTION

I. Problems to be solved:

1. In the disclosure, the color temperature is controlled by pressing the power switch (a wired switch) with different pressing times. Namely, different pressing times present different means for outputting color temperature or color in an LED array. Herein, a dimmer can not be utilized to control the illumination of the LED since the color temperature adjuster is driven by the power switch containing direct current to output a power signal in accordance with a predetermined color temperature value. Thereby, the LED illuminates accordingly. If the dimmer is utilized to adjust the current and control the illumination of the LED, signals from the dimmer adversely interfere with driving signals of a color temperature switcher. Unfavorably, the LED provides flickering light.

2. In order to decrease influences of adjusting current phase angle of the dimmer on the color temperature switcher, an in order to prevents the LED from providing flickering light, a controlling switch is further installed on the color temperature switcher for individually altering the outputting controlling signal of the color temperature value. II. Means for solving the problems:

1. A synchronous and dimmer action detection differentiates an action of a dimmer and an action of an ON/OFF count via the dimmer and the LED color or color temperature output controller. The LED color or color temperature output controller outputs a signal presenting a color temperature value in accordance with an action selected by the ON/OFF count, thereby allowing an LED array to emit an accordant color temperature or color suited to the atmosphere. When the illumination is to be adjusted, the dimmer adjusts an outputting phase angle, so that a dimmable LED driver circuit transforms an alternating current signal to a direct current signal. Thereby, an output current is able to control the illumination of the color temperature or color of the LED array. Preferably, the signals from the LED color or color temperature output controller are not influenced by the dimmer altering the current, so that even if the light is being emitted, the illumination can be adjusted stably. Therefore, the light does not flicker, and the color or color temperature do not deviate.

2. A reset function is set in every circulation of pressing the ON/OFF count. Each pressing has a correspondent signal set in the color temperature value of the LED color or color temperature output controller, and controls an output of a correspondent power for driving the LED array to send a desired color temperature or color. An LED condition memory memorizes the pressing, so that after the power supply is turned off and the power supply is turned on in a next time, the LED array provides the same color temperature or color and illumination again in accordance with the prior memorized signal.

3. The LED array adopts a four-season lamp cooperating with an output color temperature of said LED color or color temperature output controller. Two strings of the LED array are arranged, one string of which is in a high color temperature arrangement and the other string of which is in a low color temperature arrangement. The ON/OFF count is applied for selecting a determined color temperature signal in accordance with the outputting light, thereby offering colored light that fits with an alternation of four seasons.

4. The two strings of the LED array are arranged by alternating a high-color-temperature arrangement with a low-color-temperature arrangement. The two strings of the LED array provide different numbers of LED lamps to adjust an output of altered color temperature, which drives the LED color or color temperature output controller to output a correspondent value for users to set an output performance as desired.

5. The LED array includes a string of red LED, a string of blue LED, and a string of white LED, which is adapted to a set value of the LED color or color temperature output controller for the LED array to emit a correspondent colored light requisite for planting and cultivating and concurrently so as to enhance growing speeds of plants and animals.

6. The LED array includes a string of red LED, a string of blue LED, a string of green LED, and a string of white LED. The LED color or color temperature output controller is controlled by the ON/OFF count and the dimmer so as to provide a set value for the LED array to emit a correspondent colored light that is especially suited to a business environment or a home atmosphere.

BRIEF DESCRIPTION OF THE DRAWINGS

FIG. 5-A is a waveform showing that a dimmer and an ON/OFF count provide controlling, an LED color or color temperature output controller outputs signals, and an LED outputs currents;

FIG. 5-B is a waveform showing that the dimmer is adjusted to a low phase angle for outputting power;

FIG. 5-C is a waveform showing that the dimmer is adjusted to a full phase angle for outputting power;

FIG. 5-D is a waveform that is compared with the waveform of FIG. 5-B transformed to a direct current via a dimmable LED driver circuit;

FIG. 5-E is a waveform that is compared with the waveform of FIG. 5-C transformed to a direct current via a dimmable LED driver circuit;

FIG. 6-A is a waveform showing that a synchronous and dimmer action detection outputs a switch direct current to the LED color or color temperature output controller for determining a code of a color temperature value, so that an LED condition memory writes the value;

FIG. 6-B is a waveform showing that a synchronous and dimmer action detection outputs a switch direct current to the LED color or color temperature output controller for reading the code of the color temperature value written in the LED condition memory; thereby, the signal code is written in the LED condition memory again;

FIG. 6-C is a waveform showing that the ON/OFF count records the pressing times, the synchronous and dimmer action detection outputs the switch direct current for the LED color or color temperature output controller to output the code of the LED array, so that a light is emitted;

FIG. 6-D is a waveform showing that the ON/OFF count records the pressing times, the synchronous and dimmer action detection outputs the switch direct current for the LED color or color temperature output controller to output the code of the LED array, so that a light is emitted with variety.

DESCRIPTION OF ELEMENTS IN THE DRAWINGS

Figure 1:
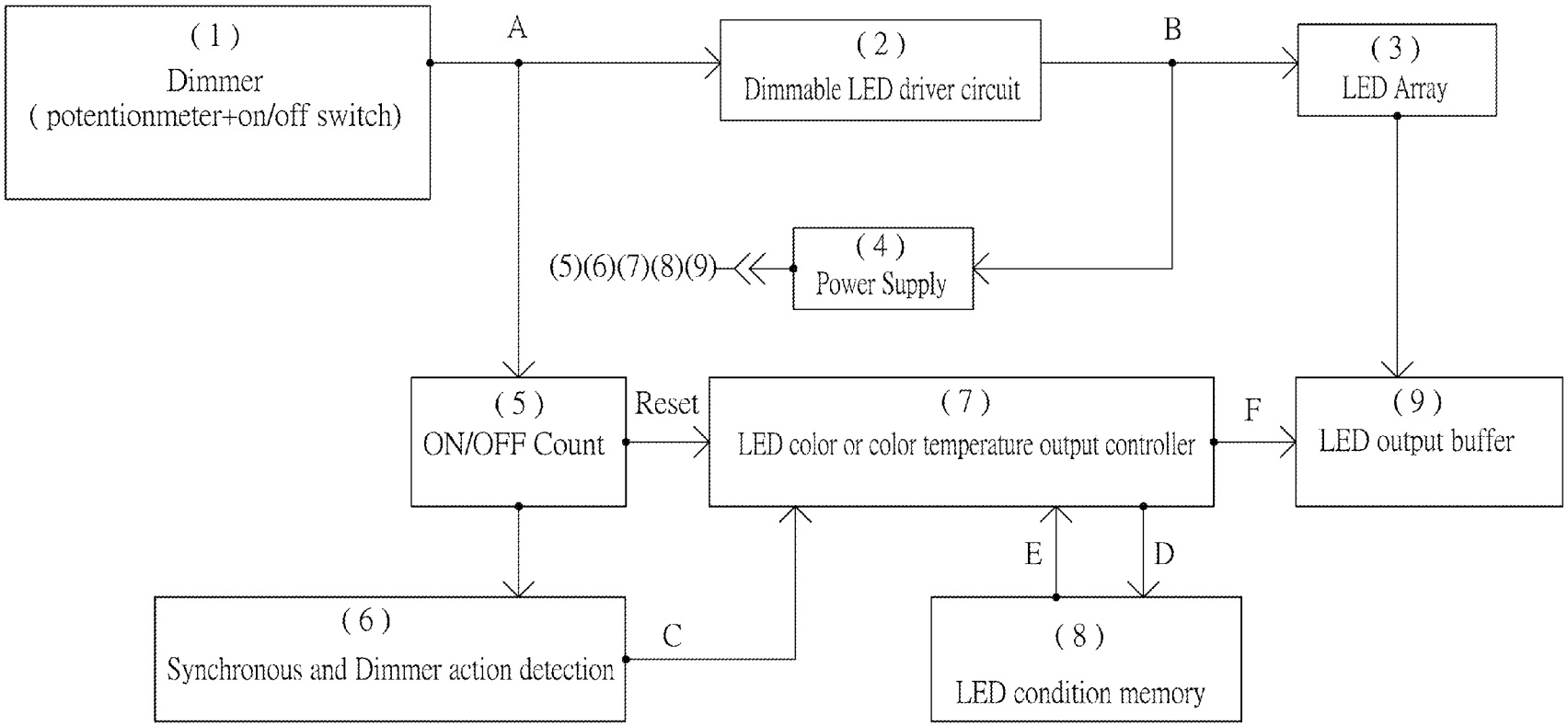
FIG. 1 is a block chart of the present invention.

1 dimmer
2 dimmable LED driver circuit
3 LED array
4 power supply
5 ON/OFF count
6 synchronous and dimmer action output controller
7 LED color or color temperature output controller
8 LED condition memory
9 LED output buffer

DETAILED DESCRIPTION OF THE PREFERRED EMBODIMENTS

FIG. 1 shows an LED driver in accordance with the present invention comprising:

a dimmer (1) connected to a dimmable LED driver circuit (2) and an input end of an ON/OFF count (5);

a dimmable LED driver circuit (2) having an input end connected to an output end of the dimmer (1) and the input end of the ON/OFF count (5), an output end of the dimmable LED driver circuit (2) being connected to an LED array (3) and an input end of a power supply (4);

the input end of the power supply (4) being connected to the output end of the dimmable LED driver circuit (2) and an input end of the LED array (3), respectively; an output end of the power supply (4) being respectively connected to the ON/OFF count (5), a synchronous and dimmer action detection (6), an LED color or color temperature output controller (7), an LED condition memory (8), and an input end of an LED output buffer (9);

the input end of the LED array (3) being respectively connected to the output end of the dimmable LED driver circuit (2) and the input end of the power supply (4); an output end of the LED array (3) being connected to one input end of the LED output buffer (9);

the input end of the ON/OFF count (5) being respectively connected to the output end of the dimmer (1) and the input end of the dimmable LED driver circuit (2); one output end of the ON/OFF count (5) being respectively connected to the LED color or color temperature output controller (7) and an input end of the synchronous and dimmer action detection (6);

the input end of the synchronous and dimmer action detection (6) being connected to the output end of the ON/OFF count (5); the input end of the synchronous and dimmer action detection (6) being connected to an input end of the LED color or color temperature output controller (7);

the input end of the LED color or color temperature output controller (7) being respectively connected to the other output end of the ON/OFF count (5) and an output end of the synchronous and dimmer action detection (6); a data gate of the LED color or color temperature output controller (7) being connected to the LED condition memory (8) and the other input end of the LED output buffer (9); whereby, the LED color or color temperature output controller (7) is able to read/write data in the LED condition memory (8);

the input end of the LED output buffer (9) being respectively connected to the LED array (3) and an output end of the LED color or color temperature output controller (7), thereby receiving an output signal from the LED color or color temperature output controller (7) and controlling a color temperature or a color of the LED array (3) to be properly output.

Wherein, when the dimmer (1) (as shown in FIG. 5-A) is turned on/off to measure a power signal on an output point A in FIG. 1 (as shown in FIG. 5-A), the synchronous and dimmer action detection (6) synchronically differentiates an action of the dimmer (1) and an action of the ON/OFF count (5) via the dimmer (1) and the LED color or color temperature output controller (7) since the action of the dimmer (1) and an action for adjusting the color temperature or color can not work together. The LED color or color temperature output controller (7) outputs a signal presenting a color temperature value in accordance with an action selected by the ON/OFF count (5) (as shown in FIG. 1 that the power signal is measured on an output point C), thereby allowing the LED array (3) to emit an accordant color temperature or color suited to the atmosphere (as shown in FIG. 6-A to D). When the illumination is to be adjusted, the dimmer (1) adjusts an phase angle of the output current for changing the output current, so that the dimmable LED driver circuit (2) transforms an alternating current signal to a direct current signal (as shown in FIG. 1 that a controlling signal is measured on an output point B). Thereby, the illumination of the color temperature or color of the LED array (3) is adjustable (as shown in FIGS. 5-B to 5-E). Preferably, the signals from the LED color or color temperature output controller (7) are not influenced by the dimmer (1) altering the current, so that even if the light is being emitted, the illumination can be adjusted stably. Therefore, the light does not flicker, and the color or color temperature do not deviate.

Referring to FIG. 1 and FIGS. 6-A to 6-D, a reset function (as shown in FIG. 6-D) is set in every circulation of pressing the ON/OFF count (5). Each pressing has a correspondent signal set in the color temperature value of the LED color or color temperature output controller (7), and controls an output of a correspondent power for driving the LED array (3) to send a desired color temperature or color. The LED condition memory (8) memorizes the pressing, so that after the power supply is turned off and the power supply is turned on in a next time (as shown in FIGS. 6-C to 6-D), the LED array (3) provides the same color temperature or color and illumination again in accordance with the prior memorized signal.

Referring to FIGS. 1 to 4, the LED array (3) adopts a four-season lamp cooperating with an output color temperature of the LED color or color temperature output controller (7). Two strings of the LED array are arranged, one string of which is in a high color temperature arrangement and the other string of which is in a low color temperature arrangement. The ON/OFF count (5) is applied for selecting a determined color temperature signal in accordance with the outputting light, thereby allowing the LED color or color temperature output controller (7) to provide a correspondent color temperature value and offer colored light that first with an alternation of four seasons.

Figure 2:
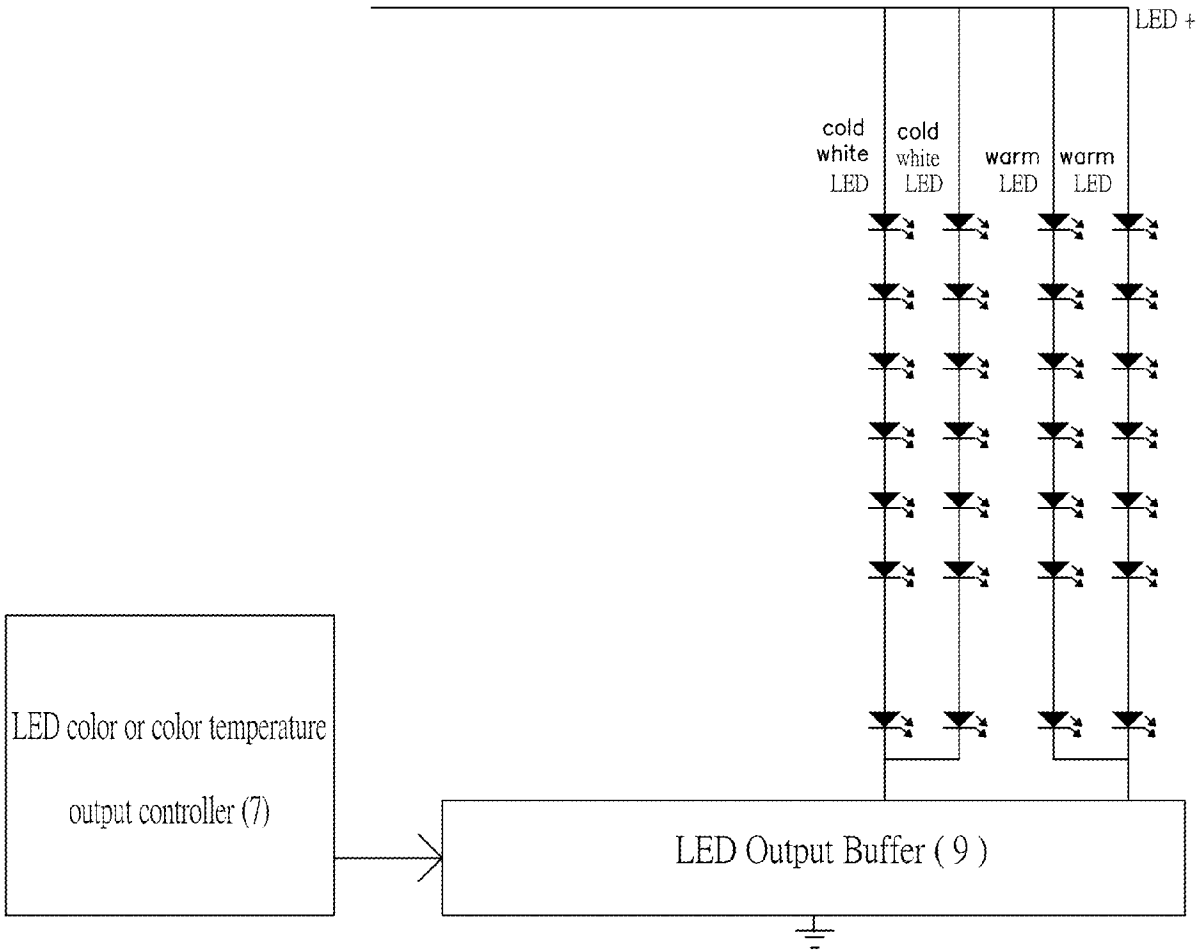
FIG. 2 is a schematic view showing an LED array of a first preferred embodiment of the present invention.

Referring to FIGS. 1 to 2, the two strings of the LED array (3) are arranged by alternating a high-color-temperature arrangement with a low-color-temperature arrangement. The two strings of the LED array provide different numbers of LED lamps to adjust an output of altered color temperature, which drives the LED color or color temperature output controller (7) to output a correspondent value for users to set an output performance as desired.

Figure 3:
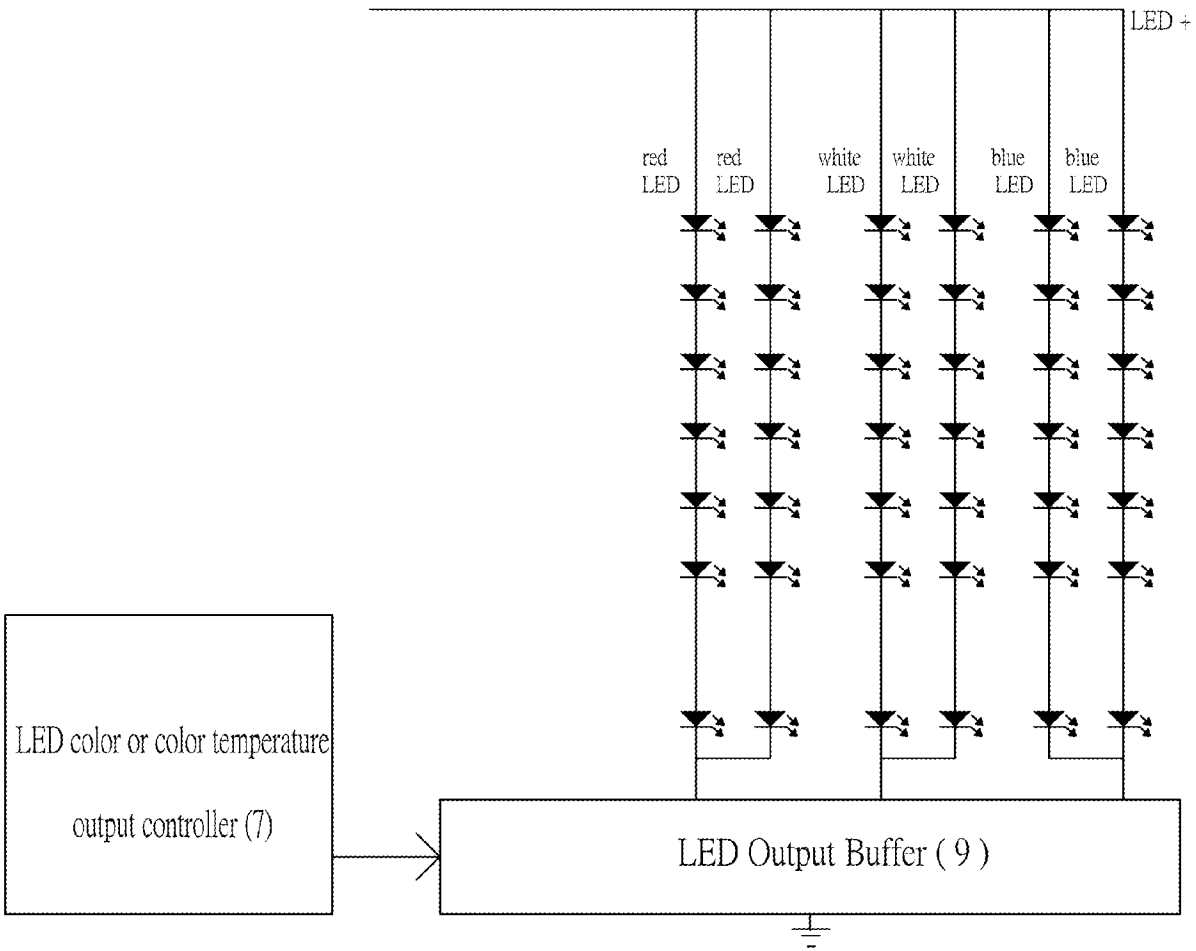
FIG. 3 is a schematic view showing the LED array of a second preferred embodiment of the present invention.

Referring to FIGS. 1 and 3, the LED array (3) includes a string of red LED, a string of blue LED, and a string of white LED, which is adapted to a set value of the LED color or color temperature output controller (7) for the LED array (3) to emit a correspondent colored light requisite for planting and cultivating and concurrently so as to enhance growing speeds of plants and animals.

Figure 4:
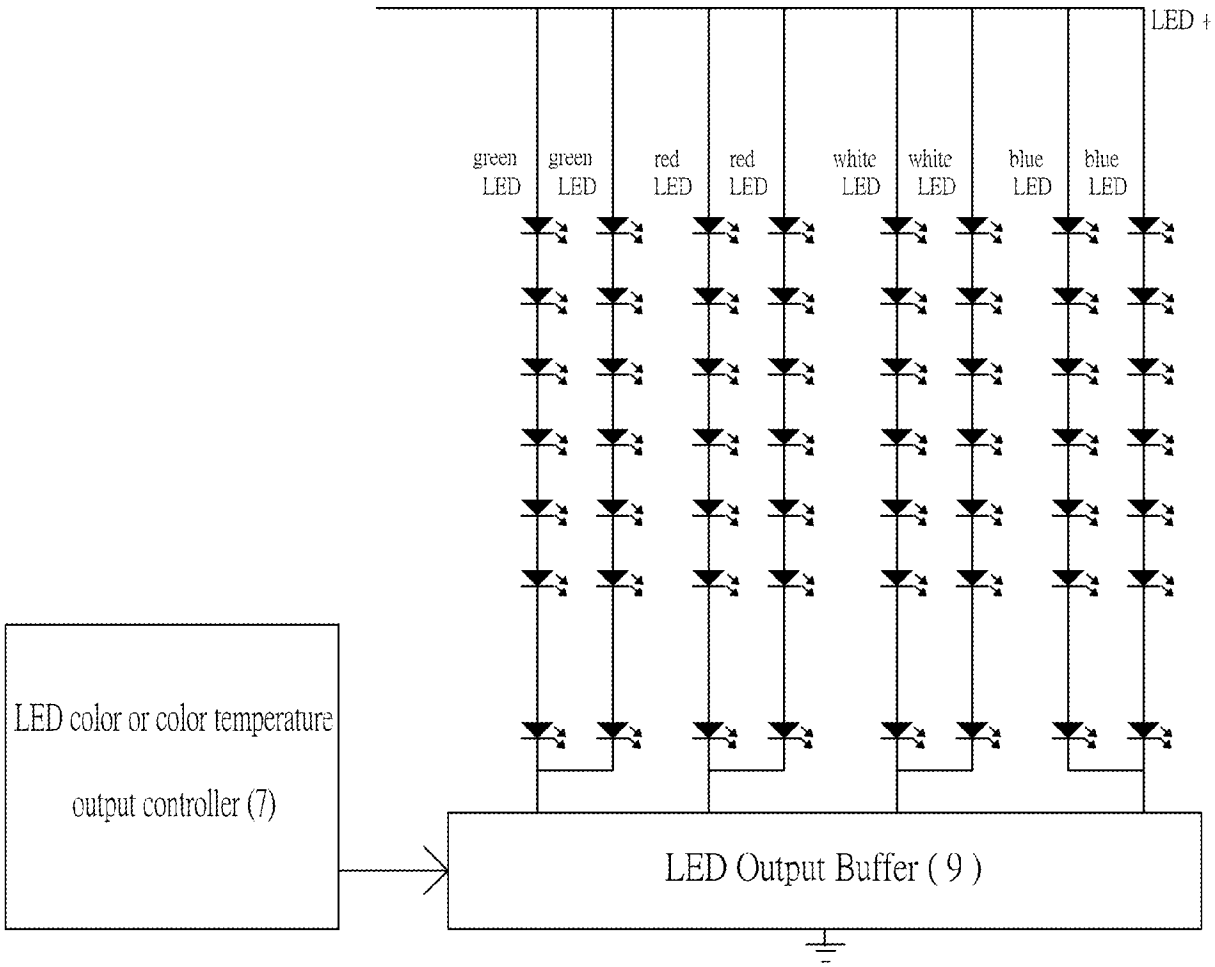
FIG. 4 is a schematic view showing the LED array of a third preferred embodiment of the present invention.

Referring to FIGS. 1 and 4, the LED array (3) includes a string of red LED, a string of blue LED, a string of green LED, and a string of white LED. The LED color or color temperature output controller (7) is controlled by the ON/OFF count (5) and the dimmer (1) so as to provide a set value for the LED array (3) to emit a correspondent colored light that is especially suited to a business environment or a home atmosphere.

A control signal is adopted as aforesaid. The dimmer (1) allows the circuit to output a signal so as to adjust illumination of the LED array (3) via a power carrier. Alternatively, the ON/OFF count (5) allows the LED color or color temperature output controller (7) to output a signal so as to adjust the color temperature or color of the LED array (3). Preferably, two power circuits are enough for adjusting illumination, color temperature, and color, which further prevents flickering light and deviating color or color temperature.

I claim:

1. An LED driver capable of controlling color/color temperature with a power carrier comprising:

a dimmer connected to a dimmable LED driver circuit and an input end of an ON/OFF count;

the dimmable LED driver circuit having an input end connected to an output end of said dimmer and said input end of said ON/OFF count, an output end of said dimmable LED driver circuit being connected to an LED array and an input end of a power supply;

said input end of said power supply being connected to said output end of said dimmable LED driver circuit and an input end of said LED array, respectively; an output end of said power supply being respectively connected to said ON/OFF count, a synchronous and dimmer action detection, an LED color or color temperature output controller, an LED condition memory, and an input end of an LED output buffer;

said input end of said LED array being respectively connected to said output end of said dimmable LED driver circuit and said input end of said power supply; an output end of said LED array being connected to one input end of said LED output buffer;

said input end of said ON/OFF count being respectively connected to said output end of said dimmer and said input end of said dimmable LED driver circuit; one output end of said ON/OFF count being respectively connected to said LED color or color temperature output controller and an input end of said synchronous and dimmer action detection;

said input end of said synchronous and dimmer action detection being connected to said output end of said ON/OFF count; said input end of said synchronous and dimmer action detection being connected to an input end of said LED color or color temperature output controller;

said input end of said LED color or color temperature output controller being respectively connected to the other output end of said ON/OFF count and an output end of said synchronous and dimmer action detection; a data gate of said LED color or color temperature output controller being connected to said LED condition memory and the other input end of said LED output buffer, whereby said LED color or color temperature output controller is able to read/write data in said LED condition memory;

said input end of said LED output buffer being respectively connected to said LED array and an output end of said LED color or color temperature output controller, thereby receiving an output signal from said LED color or color temperature output controller and controlling a color temperature or a color of said LED array to be properly output;

wherein, when said dimmer is turned on/off to output a power signal, said synchronous and dimmer action detection synchronically recognizes actions of said dimmer or said LED color or color temperature output controller; said LED color or color temperature output controller outputs a signal presenting a color temperature value in accordance with an action selected by said ON/OFF count, thereby allowing said LED array to generate a correspondent color temperature or color suited to the environment;

said dimmer alters a phase angle of an outputting current to control a volume of said outputting current so as to adjust illumination; said dimmable LED driver circuit transforms an alternating current to a direct current so as to control a volume of an outputting power of said LED color or color temperature output controller, thence adjusting illumination of said color temperature or color of said LED array; signals from said LED color or color temperature output controller are not influenced by said dimmer altering said outputting current, so that said LED color or color temperature output controller provides a stable illumination adjustment so as to prevent flickering light and deviating color or color temperature.

2. The LED driver as claimed in claim 1, wherein, a reset function is set in every circulation of pressing said ON/OFF count; each pressing has a correspondent signal set in said color temperature value of said LED color or color temperature output controller and controls an output of a correspondent power for driving said LED array to send a desired color temperature or color; said LED condition memory memorizes said pressing, so that after said power supply is turned off and said power supply is turned on in a next time, said LED array provides the same color temperature or color and illumination again in accordance with said prior memorized signal.

3. The LED driver as claimed in claim 1, wherein, said LED array adopts a four-seasons lamp cooperating with an output color temperature of said LED color or color temperature output controller; two strings of said LED array are arranged, one string of which is in a high-color-temperature arrangement and the other string of which is in a low-color-temperature arrangement; said ON/OFF count is applied for selecting a determined color temperature signal in accordance with said outputting light, thereby allowing said LED color or color temperature output controller to provide a correspondent color temperature value and offer colored light that fits with an alternation of four seasons.

4. The LED driver as claimed in claim 3, wherein, said two strings of said LED array are arranged by alternating a high-color-temperature arrangement with a low-color-temperature arrangement; said two strings of said LED array provide different numbers of LED lamps to adjust an output of altered color temperature, which drives said LED color or color temperature output controller to output a correspondent value for users to set an output performance as desired.

5. The LED driver as claimed in claim 3, wherein, said LED array includes a string of red LED, a string of blue LED, and a string of white LED, which is adapted to a set value of said LED color or color temperature output controller for said LED array to emit a correspondent colored light requisite for planting and cultivating and concurrently so as to enhance growing speeds of plants and animals.

6. The LED driver as claimed in claim 3, wherein, said LED array includes a string of red LED, a string of blue LED, a string of green LED, and a string of white LED; said LED color or color temperature output controller is controlled by said ON/OFF count and said dimmer so as to provide a set value for said LED array to emit a correspondent colored light that is especially suited to a business environment or a home atmosphere.

7. The LED driver as claimed in claim 1, wherein, said dimmer outputs an output signal by said dimmable LED driver circuit and said ON/OFF count selects an output signal from said LED color or color temperature output controller, whereby said output signals are directly emitted to said LED array via said power carrier so as to adjust illumination and color temperature or color.

* * * * *